US007198546B2

(12) United States Patent
Berman et al.

(10) Patent No.: US 7,198,546 B2
(45) Date of Patent: Apr. 3, 2007

(54) METHOD TO MONITOR PAD WEAR IN CMP PROCESSING

(75) Inventors: Michael Berman, West Linn, OR (US); Steven Reder, Boring, OR (US); Matthew R. Trattles, Troutdale, OR (US)

(73) Assignee: LSI Logic Corporation, Milpitas, CA (US)

( * ) Notice: Subject to any disclaimer, the term of this patent is extended or adjusted under 35 U.S.C. 154(b) by 106 days.

(21) Appl. No.: 10/879,629

(22) Filed: Jun. 29, 2004

(65) Prior Publication Data

US 2005/0287927 A1 Dec. 29, 2005

(51) Int. Cl.
*B24B 49/00* (2006.01)

(52) U.S. Cl. ..... 451/8; 451/28; 451/5; 451/527

(58) Field of Classification Search ..... 451/8, 451/5, 21, 527, 28, 56
See application file for complete search history.

(56) References Cited

U.S. PATENT DOCUMENTS 5,882,251 A 3/1999 Berman et al.
5,934,974 A * 8/1999 Tzeng ..... 451/5
6,045,434 A * 4/2000 Fisher et al. ..... 451/21
6,616,513 B1 * 9/2003 Osterheld ..... 451/527
6,685,548 B2 * 2/2004 Chen et al. ..... 451/527
6,702,646 B1 * 3/2004 Gitis et al. ..... 451/8
2002/0137434 A1 * 9/2002 Choi et al. ..... 451/28
2003/0060127 A1 * 3/2003 Kaushal et al. ..... 451/8

* cited by examiner

*Primary Examiner*—Hadi Shakeri
(74) *Attorney, Agent, or Firm*—Trexler, Bushnell, Giangiorgi, Blackstone & Marr, Ltd.

(57) ABSTRACT

A pad groove analyzer and associated method configured to assess the grooves on the pad and determine how worn the pad is. The pad groove analyzer may be configured to monitor the grooves via a contact or no-contact process. In a contact process, the pad groove analyzer may include a stylus which physically contacts and moves along the pad. As the stylus falls into the grooves in the pad as the stylus moves along the pad, signals are created, and a stylus monitor uses the signals to determine to what extent the pad is worn. The stylus monitor can be configured to communicate with the general tool controller. In a no-contact process, the pad groove analyzer may take several different forms.

3 Claims, 2 Drawing Sheets

METHOD TO MONITOR PAD WEAR IN CMP PROCESSING

BACKGROUND

The present invention generally relates to CMP processing, and more specifically relates to an apparatus and method for monitoring pad wear in CMP processing.

An integrated circuit (IC) chip is a sandwiched, multiple layer structure which typically includes a silicon substrate, dielectric layers, metal interconnects, devices and so on. Every layer is formed by deposition, photolithographic, etching, as well as other techniques. Every layer must be planar and, as the features get smaller, the requirement for planarity gets more stringent. Chemical Mechanical Polishing (CMP) plays an important part in planarizing every layer before the next top layer is deposited. The CMP process involves pressing the face of the wafer to be polished against a compliant polymeric polishing pad and generating relative motion between the interface between the wafer and the pad. A slurry consisting of abrasives and chemicals is fed in between the interface between the wafer and the pad. The combined chemical action of the chemicals in the slurry and the mechanical action of the abrasives cause material to be removed from the wafer. A typical CMP setup looks very similar to a lapping machine, but the precision is much higher and there is a lot more sophistication.

One of the most commonly-used devices for polishing a semiconductor wafer is a rotational format CMP machine as illustrated in FIG. 1. The wafer 10 is held in a wafer carrier 12, and is pressed against a polishing pad 14 which is disposed on a polishing table 16. Both the wafer carrier 12 and polishing table 16 are then rotated (as indicated by arrows 18 in FIG. 1), and slurry is supplied on the pad 14 via a stationary slurry dispense line 20. The stationary slurry dispense line 20 is used to drip slurry 22 on the pad 14 in front on the wafer 10.

In CMP processing, the pad (identified with reference numeral 14 in FIG. 1) is typically provided as having grooves in its polishing surface for slurry distribution and improved pad-wafer contact. U.S. Pat. No. 5,882,251 provides a detailed disclosure of CMP processing pads and their different groove designs. U.S. Pat. No. 5,882,251 is hereby incorporated herein by reference in its entirety.

The pads used for processing STI, oxide, tungsten or copper all have grooves machined or embossed into the pad. The grooves are critical for proper slurry transportation or distribution under the wafer. As the pads wear out, the depth of the grooves decreases. When the pad is fully exhausted or worn-out, the pad will be flat on the surface. In other words, the grooves will cease to exist. When this happens, uniformity and polish rate of the pad changes dramatically, and any material processed during this time is likely to be out of specifications and require rework or scrap.

Typically, the pad is the primary consumable that wears out over the course of processing. While pad wear is typically very inconsistent, pads often need to be replaced as often as every other day. More specifically, pads routinely reach full exhaustion after anywhere between 18 and 25 hours of use. While this is the average, due to the inconsistency of pad wear, it is not uncommon for a pad to fail much sooner, such as after only 15 hours of use.

The two methods which are currently widely used in the industry to prevent excessive pad wear from causing control issues in processing are: 1) changing pads more frequently (i.e., reducing the number of hours between pad changes); and 2) requiring additional operator monitoring by visual inspection prior to processing wafers with pads over 15 hours (or some other predetermined period of usage).

The first method (i.e., changing pads more frequently) is undesirable due to the high cost and long downtime associated with changing pads. It is expensive to change pads. Additionally, changing pads requires considerable downtime—the old pad must be swapped out for the new pad, and the new pad must be broken in as well as re-qualified. If pads are changed three or more times a week, a reduced pad life by 10, 15 or 20% can amount to substantial increased cost.

The second method (i.e., inspecting older pads before continuing to use them in a CMP process) has generally proved to be unacceptable. Because of system layout, poor lighting in the process chamber, and tool interlocks, visual observation of groove depth of the pad has proven not to be sufficient.

OBJECTS AND SUMMARY

An object of an embodiment of the present invention is to provide an apparatus and method for monitoring pad wear in CMP processing.

Another object of an embodiment of the present invention is to provide an apparatus and method for monitoring pad wear so that it can be accurately determined when the pad should be changed for a new pad.

Briefly, and in accordance with at least one of the foregoing objects, an embodiment of the present invention provides a pad groove analyzer and associated method. The pad groove analyzer is configured to assess the grooves on the pad and determine how worn the pad is. The pad groove analyzer may be configured to monitor the grooves via a contact or no-contact process.

In a contact process, the pad groove analyzer may include a stylus which physically contacts and moves along the pad. As the stylus falls into the grooves in the pad as the stylus moves along the pad, signals are created, and a stylus monitor uses the signals to determine to what extent the pad is worn (i.e., how shallow have the grooves become). The stylus monitor can be configured to communicate with the general tool controller which may, thereafter, take a certain action, such as shutting the tool down or alerting the operator that the pad is too worn for subsequent use in a CMP process.

In a no-contact process, the pad groove analyzer may take several different forms. For example, it may consist of an electromagnetic impedance analyzer, a laser and laser reflection analyzer, or an ultrasound transmitter and receiver/analyzer (i.e., a thickness gauge), to name a few.

BRIEF DESCRIPTION OF THE DRAWINGS

The organization and manner of the structure and operation of the invention, together with further objects and advantages thereof, may best be understood by reference to the following description, taken in connection with the accompanying drawing, wherein.

DESCRIPTION

Figure 1:
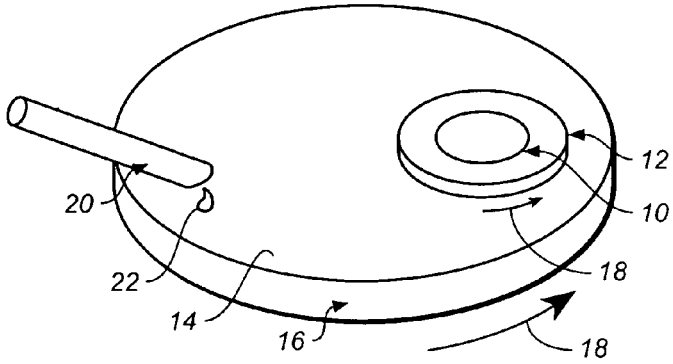
FIG. 1 (PRIOR ART)
FIG. 1 illustrates a conventional rotational format CMP machine.

While the invention may be susceptible to embodiment in different forms, there are shown in the drawings, and herein will be described in detail, specific embodiments of the invention. The present disclosure is to be considered an example of the principles of the invention, and is not intended to limit the invention to that which is illustrated and described herein.

Figure 2:
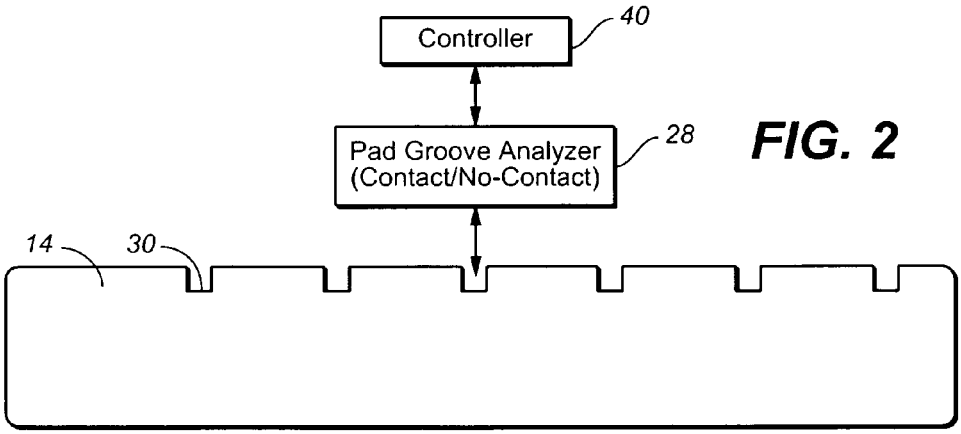
FIG. 2 illustrates a pad groove analyzer being used to analyze the wear of grooves on a pad, in accordance with an embodiment of the present invention.

As shown in FIG. 2, the present invention provides a pad groove analyzer 28 (and associated method) which is configured to assess grooves 30 on a CMP polishing pad 14 and determine how worn the pad is. The pad groove analyzer 28 may be configured to assess or monitor the grooves 30 via a contact or no-contact process. By monitoring pad wear, it can be accurately determined when the pad should be changed for a new pad.

Figure 3:
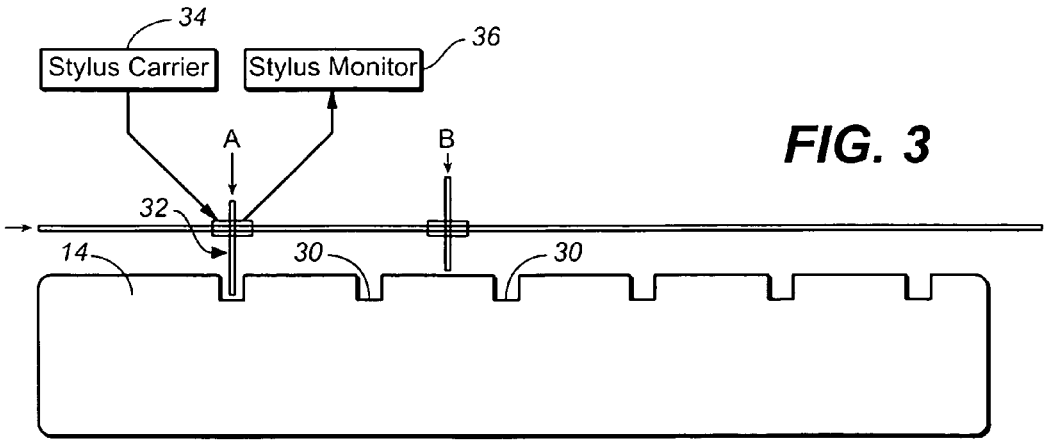
FIG. 3 illustrates a contact-type pad groove analyzer which uses a stylus to determine the depth of grooves on the pad.

FIG. 3 illustrates the situation where the pad groove analyzer assesses the grooves 30 via a contact process (i.e., surface profile management), wherein the pad groove analyzer includes a stylus 32 on the pad which physically contacts and moves along the pad. In FIG. 3, the stylus 32 is shown in two different positions—in a groove 30 (position "A" in FIG. 3); and on the pad 14, outside any of the grooves 30 (position "B" in FIG. 3). The stylus is mounted to a stylus carrier 34 and is in communication with a stylus monitor 36. The stylus carrier 34 may comprise an additional arm mounted on the side of the polishing chamber, wherein the stylus 32 is small and is mounted on the bottom of the arm. Alternatively, the stylus 32 can be integrated into the existing pad conditioning system or the actual wafer carrier.

Regardless, the stylus 32 is moved across the surface of the polishing pad 14, and the stylus monitor 36 monitors drag of the stylus 32. This can be performed while processing, during pad conditioning or at some other time in the wafer processing cycle. As the stylus 32 drags across the surface of the pad 14, it will periodically bump into a groove 30, causing a sudden change in the drag the stylus 32 has on the arm (or other associated structure). This change in drag is monitored by the stylus monitor 36 using one of many techniques depending on the configuration of the stylus monitor 36 (such as capacitance and moving magnetic coil). Change in drag of the stylus 32 causes an electric signal to be generated. As the depth of the grooves 30 decreases, the signal generated by the stylus 32 also decreases. Eventually, as the pad 14 becomes bald, the periodic signal from the grooves 30 becomes zero. This signal (or lack thereof) can not only indicate when the new pad is completely worm out, but can be used to profile a pad and monitor for difference pad to pad, both incoming and in process over time.

If the stylus 32 is sized properly, then groove depth can be monitored throughout the entire course of the pad life. This will allow, not only end-of-life warnings, but also facilitate advanced process control for pad conditioning, to ensure proper conditioning of the complete pad and on all zones of the pad. Grooves on a typical pad are on the order of 50 mils wide and 50 mils deep (when new). In order to find the full depth, the stylus should be of the order of <=35% the width of the grove. A wider stylus can be used to find the full depth, but a slower movement will be required.

The stylus monitor 36 can be connected to the main tool controller (40 in FIG. 2) or be an integral part thereof, such that as the pad wear rate is monitored, and if a pad conditioner problem is detected, the entire tool can be shut down and the process owner can be alerted. By providing that the stylus monitor 36 communicates with the general tool controller, an active feedback system can be provided to monitor pad wear, pad conditioning, and groove end of life.

The present invention provides a diagnostic tool which has the ability to monitor pad wear during the course of the pad life. There are three uses, they are:

1. The system can function as an alert to the control system prior to a pad end-of-life (i.e., a go/no-go gauge).
2. The ability to monitor failures (mechanical or consumable) on the pad conditioning system and alert the tool owner of the malfunction.
3. A monitor of the pad wear rate, thereby verifying that the systems are all working to the proper et-ups parameters.

As an alternative to providing that the pad groove analyzer 28 assesses wear of the groves via contact technique, the pad groove analyzer 28 can instead be provided to monitor wear of the pad without physically contacting the pad. In a no-contact process, the pad groove analyzer may take several different forms.

Figure 4:
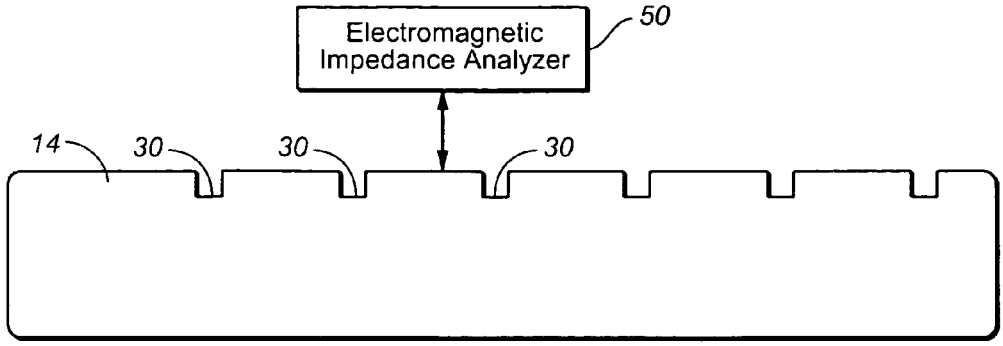
FIGS. 4–6 illustrate different no-contact pad groove analyzers.

FIG. 4 illustrates where the pad groove analyzer is provided in the form of an electromagnetic impedance analyzer 50. In such case, the electromagnetic impedance analyzer 50 analyzes the different electromagnetic impedances between the grooves 30 and the pad 14.

Figure 5:
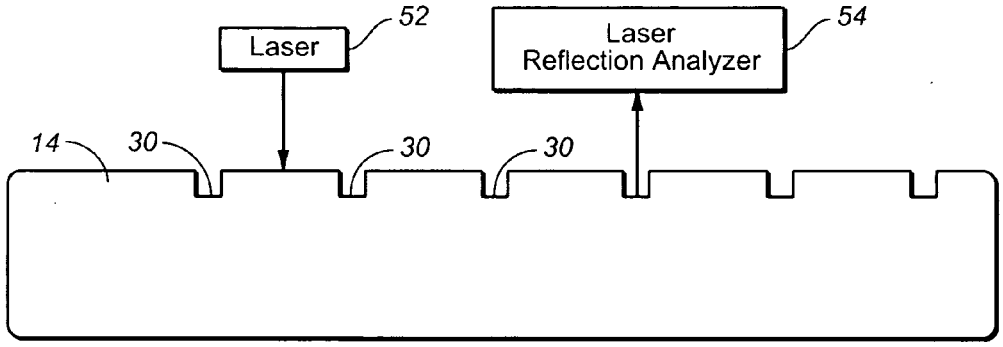

FIG. 5 illustrates where the pad groove analyzer is provided in the form of a laser 52 and a laser reflection analyzer 54. In such case, the laser 52 is aimed at the pad 14, and the reflection of the laser 52 is received and analyzed by the laser reflection analyzer 54 to determine the depths of the grooves 30 on the pad 14.

Figure 6:
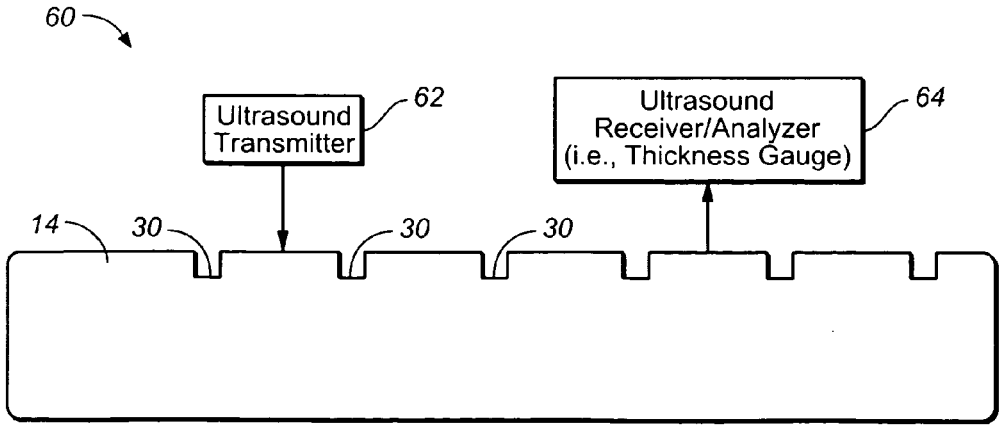

FIG. 6 illustrates where the pad groove analyzer is provided in the form of an ultrasound thickness gauge 60. Specifically, an ultrasound transmitter 62 transmits ultrasounds and an ultrasound transmitter/analyzer 64 receives the reflected ultrasounds and calculates the thickness of the pad. Specifically, the ultrasound thickness gauge may comprise the GE Power Systems Series 25 or High-Precision thickness gauge.

Regardless of which system is used, and whether the system is contact or no-contact with regard to the pad, by monitoring pad wear (i.e., the grooves formed therein), it can be accurately determined when a pad should be changed for a new pad.

While embodiments of the present invention are shown and described, it is envisioned that those skilled in the art may devise various modifications of the present invention without departing from the spirit and scope of the appended claims.

What is claimed is:

1. A pad groove analyzer for use in association with a pad which includes grooves and is configured for use in a CMP process, said pad groove analyzer configured to assess the grooves on the pad and determine how worn the pad is, said pad groove analyzer being configured to assess the grooves by contacting the pad, further comprising a stylus which has a width which is less than or equal to 35% of the grooves on the pad and which is configured to physically contact and move along the pad, into and out of the grooves.

2. A pad groove analyzer as recited in claim 1, further comprising a stylus monitor associated with said stylus, said stylus monitor configured to use the stylus to determine to what extent the pad is worn.

3. A method for assessing the wear of groove of a pad configured for use in a CMP process, said method comprising using a pad groove analyzer to assess the grooves on the pad and determine how worn the pad is by contacting the pad, further comprising moving a stylus across the pad, into and out of the grooves, wherein the stylus has a width which is less than or equal to 35% of the width of the grooves on the pad.

* * * * *